US005497357A

United States Patent [19]

Dahlstrom et al.

[11] Patent Number: 5,497,357

[45] Date of Patent: Mar. 5, 1996

[54] SHOCK-RESISTANT FLEXTENSIONAL TRANSDUCER

[75] Inventors: David K. Dahlstrom, Burbank; Theodore R. Kazmar, Saugus, both of Calif.

[73] Assignee: AlliedSignal Inc., Morris Township, N.J.

[21] Appl. No.: 288,329

[22] Filed: Dec. 23, 1988

[51] Int. Cl.[6] ..... H04R 17/00; H04R 31/00

[52] U.S. Cl. ..... 367/158; 367/165; 310/337

[58] Field of Search ..... 181/122, 402; 367/141, 152, 155, 157, 158, 159, 160, 162, 163, 165, 166, 171, 174, 177, 178, 180, 188; 310/337, 325, 369

[56] References Cited

U.S. PATENT DOCUMENTS

| | | | |
|---|---|---|---|
| 3,258,738 | 6/1966 | Merchant | 367/157 |
| 3,274,537 | 9/1966 | Toulis | 367/157 |
| 3,311,873 | 3/1967 | Schloss | 367/158 |
| 3,846,744 | 11/1974 | Renna, Jr. et al. | 367/165 |
| 4,287,582 | 9/1981 | Tocquet | 367/155 |
| 4,420,826 | 12/1983 | Marshall, Jr. et al. | 367/167 |
| 4,462,093 | 7/1984 | Upton | 367/165 |
| 4,731,764 | 3/1988 | Ponchaud | 367/158 |
| 4,764,907 | 8/1988 | Dahlstrom et al. | 367/163 |
| 4,964,106 | 10/1990 | Bromfield | 367/165 |
| 4,970,706 | 11/1990 | Tocquet et al. | 367/158 |
| 5,016,228 | 5/1991 | Arnold et al. | 367/163 |
| 5,291,461 | 3/1994 | Boeglin et al. | 367/163 |
| 5,329,499 | 7/1994 | Molund et al. | 367/174 |
| 5,363,346 | 11/1994 | Maltby | 367/163 |

OTHER PUBLICATIONS

Royster, L., "The Flextensional Concept: A New Approach to the Design of Underwater Acoustic Transducers" Applied Acoustics, vol. 3, No. 2, 1970.

*Primary Examiner*—Charles T. Jordan
*Assistant Examiner*—Theresa M. Wesson
*Attorney, Agent, or Firm*—John R. Rafter

[57] ABSTRACT

An underwater sonar projector includes a one piece hollow shell of elliptical cross section having a number of transducer stacks positioned within the shell and compressively prestressed by the shell to vibrate along the major axis thereof which causes the broad surfaces between the small radius ends to vibrate in and out. To resist large external shocks the shell is made somewhat heavier than usual, a center support member or beam is placed along the minor axis of the shell and an adjustable support rod is carried in the beam which is adjusted to a length just sufficient to clear the vibrating surfaces of the projector in normal operation but which functions to limit the inward movement of the shell if exposed to an explosion. The transducer stacks include a number of columns of piezoelectric disks on each side of the support beam which are bonded together, each stack having a tail member fastened to said center support beam and a head member between the disks and the end of the shell. To minimize damage to the disks, the stacks are wrapped with glass fiber cloth. Two or more such projector units may be fastened together and the ends closed by endplates.

20 Claims, 2 Drawing Sheets

SHOCK-RESISTANT FLEXTENSIONAL TRANSDUCER

SHOCK-RESISTANT FLEXTENSIONAL TRANSDUCER

Figure 1:
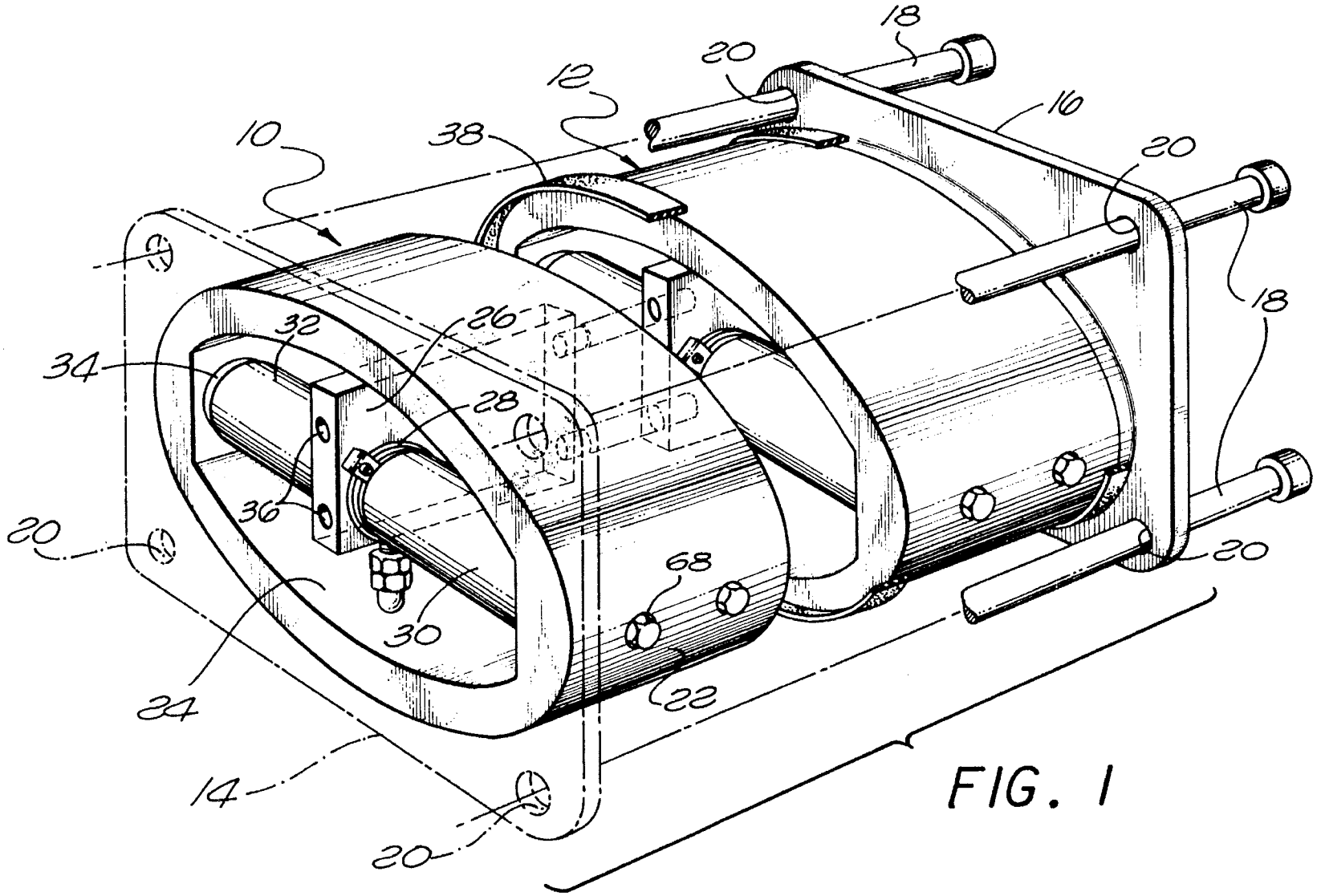

This invention relates to underwater sonar projectors and more particularly to a type of sonar projector known as Class IV flextensional transducer which is uniquely designed to resist a high degree of external physical shock.

An underwater sonar transducer of the type described consists, in general, of a one piece shell of some specified length which is hollow and of a generally elliptic cross section. The shell typically houses one or more stacks of piezoelectric ceramic elements and is designed to place a substantial compressive prestress on the ceramic elements. When an alternating voltage is placed on the piezoelectric elements, they expand and contract in such manner as to drive the narrow ends of the elliptical shell. This is transformed into large motions at the broad surfaces of the ellipse which are the major radiating surfaces.

Flextensional transducers are normally limited in the depths or the range of depths at which they can be operated successfully. Within these limitations, however, they represent a very successful design. There is now an interest in a flextensional transducer which has substantial resistance to being damaged by externally generated explosive shock.

Applicant has provided a flextensional transducer which resists damage from explosive shock by incorporating a number of features which result from consideration as to the nature and extent of damage to such transducers as a result of proximity to explosions. One type of damage is collapse of the projecting surfaces such that the metal in the surfaces is deformed beyond the point where it can return to its original shape. Other damage involves cracking or breaking of the piezoelectric elements or separation of the elements from their supporting members. Since the stack of piezoelectric elements is of ceramic material which has very low strength in tension, it is necessary that the stack be biased into a state of compression. During operation the stress on the ceramic material oscillates about its undriven compressive value. At some depth, the pressure on the projector can be such that it removes the compressive prestress from the ceramic material making it subject to damage from tensile forces. A similar effect can occur if an explosive force collapses the broad radiating surfaces inward, thus extending the ends and removing the prestress on the ceramic material. In applicant's design, the shell is made somewhat heavier than is customary, the amount of compressive prestress is somewhat greater and the internal structure is modified to limit the distance which the radiating surface can travel inward. This is accomplished by means of a center support beam or member which supports stacks of ceramic elements and which carries one or more support rods which are adjustable to limit the travel of the radiating surfaces to just that resulting from normal sonar operation. In the event of an explosive force tending to drive these surfaces further inward, they will bottom on the support rod or rods and not collapse inwardly.

IN THE DRAWINGS

Figure 2:
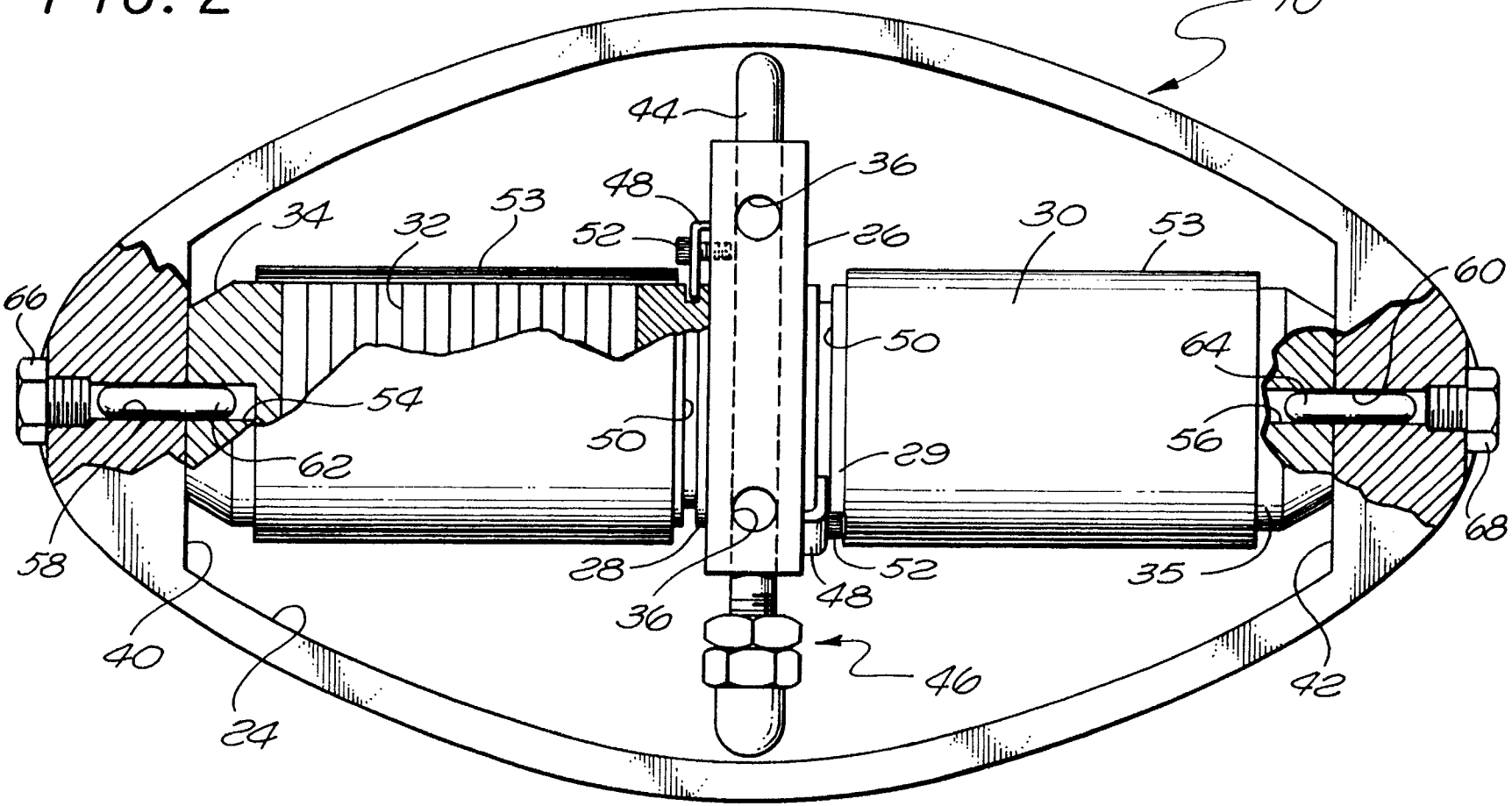

FIG. 1 is a perspective exploded drawing of a projector according to our invention; and FIG. 2 is a view (partially in cross-section) from the end of a projector such as that shown in FIG. 1.

Referring now to FIG. 1, the projector is shown in a perspective exploded view and includes two essential identical projector units 10 and 12 with end plates 14 (shown in phantom) and 16. The two projector units are held together by means of a plurality of bolts 18 which pass through holes 20 in the corners of the endplates. Projector unit 10 includes a shell 22 of essentially elliptic cross-section having an interior chamber 24. Located within chamber 24 is a center support beam or member 26 to which is clamped a plurality of stack tail members 28, only one of which is visible in FIG. 1. Stacks of piezoelectric elements 30, 32 are shown on each side of center support member 20 extending from member 26 toward the sides of chamber 24. At the outside ends of stacks 30, 32 are a pair of transducer head members, only one of which is shown at numeral 34. The transducer head members are positioned between the outer ends of the stacks and the flat interior surfaces at the ends of chamber 24. Each projector unit 10 and 12 includes a separate center support beam 26 having two stacks of piezoelectric elements on each side. The combined projector with both of units 10 and 12 bolted together would therefore include eight such stacks. The center support members 26 include shallow holes or depressions 36 which mate with projections on their opposite ends to hold the units 10, 12 in alignment. Obviously it would be possible to connect more than two such elements together as described if desired. When assembled, the projector unit is made waterproof by any suitable means. A rubber seal or band 38 (shown broken away) is bonded to the seam between units 10 and .12. Similar seals may be used to prevent ingress of water between the end plates 14 and 16 and the shells of units 10 and 12.

FIG. 2 is a view from the end of unit 10. Unit 12 may be considered identical. The shell cross section is generally elliptical and the small diameter ends of the chamber 24 are made flat as shown at numerals 40, 42. The center support member 26 includes a vertical bore, shown in dotted outline, containing a support rod 44. If thought desirable two or more such rods may be carried in center support member 26, depending upon its length and possible other factors such as the need to distribute the force in the case of contact of the housing with rod 44. Rod 44 also includes means 46 for adjusting its length so that it may be precisely adjusted to clear the inside surface of chamber 24 during all normal sonar operation but will contact this surface in case of an external force tending to cause greater deformation. The end of rod 44 is threaded and the cap nut and lower nut are initially turned onto the rod 44 as far as they will go. After the stack assembly is slid into the shell, the cap nut is turned to the desired distance and the lower nut is then turned to wedge tightly against it to establish the effective length of rod 44.

The metal stack tail members 28, 29 are removably secured to the center support member 26 by means of a plurality of clips 48 which ride in grooves 50 of the tail members 28, 29 and which are secured to center support member 26 by means of screws 52. The ceramic stacks 30, 32 are formed of a suitable number of ceramic disks which are bonded together to form stacks as shown. The stacks are wrapped in layers 53 of strong fabric such as glass fiber to inhibit chipping and eroding of the ceramic material. The wrap also places the ceramic into radial pre-compression to avoid radial tensile stresses. At the opposite end of the stacks are transducer head members 34, 35 which abut against the flattened end sections 40, 42 of chamber 24. Each of head members 34, 35 has an axial bore 54, 56 which is aligned with a corresponding bore 58, 60 in the ends of the shell of unit 10. Alignment pins 62, 64 are aligned in said bores.

Threaded members 66, 68 in the small diameter ends of the shell provide access to and close the bores 58, 60. There is no bond between the metal stack head members 34, 35 and the shell so that in the case of an extreme deformation of the shell resulting in a tendency to separate the stack from the shell, no tensile stress will be imposed on the ceramic stacks. In such case the alignment pins 62, 64 assume that when the shell and head again make contact, there will be no misalignment of the stack with the shell. A layer of lubricant in the form of grease is preferably placed between the head members and the shell.

Modifications within the spirit and scope of the present invention will occur to those skilled in the art.

While the projector has been described in terms of two units 10, 12 each carrying four stacks of piezoelectric materials these numbers may vary. More units could be assembled together and/or more stacks could be built into a given unit. The shells may be of extruded aluminum and an be formed to any desired length. They could also be formed of steel. As indicated, the number of limiter rods may vary also and, if thought desirable or necessary, the ends of such rods could be contoured to mate with the adjoining part of the surface of chamber 24 to avoid deforming the shell by contact over too small an area. And while the wrap around the stacks is described as glass fiber, other strong fabrics could also be used.

We claim:

1. A flextensional sonar projector comprising a one piece elliptical housing with an elliptical interior chamber;

a center support beam extending along the minor axis of said interior chamber, a limiter rod carried in said center support beam and extending along said minor axis such that said rod does not contact the interior surface of said housing during normal operation of the projector, but which limits inward travel of said housing in the event of exposure to external explosive shock;.

a plurality of transducer stacks in said housing generally positioned along the major axis thereof including an equal number on each side of said center support beam, each stack including a plurality of piezoelectric disks stacked in a column, a transducer head member positioned between said stack and the end of said housing, a tail member positioned between the opposite end of said stack and said center support beam and end plates closing the ends of said housing.

2. A flextensional sonar projector as claimed in claim 1 wherein a plurality of said projectors are fastened together between two said end plates.

3. A flextensional sonar projector as set forth in claim 2 wherein said plurality of projectors include center support beams having mating interlocking surfaces.

4. A flextensional sonar projector as set forth in claim 3 wherein said endplates include corners extending beyond the elliptical area of said housing ends and throughbolts are positioned to extend between said endplates to secure said housings together.

5. A flextensional sonar projector as claimed in claim 2 wherein said housing includes waterproofing means on its exterior.

6. A flex tensional sonar projector as claimed in claim 5 wherein said waterproofing includes bands of elastomeric material covering external seams of said projector including those between said projectors and between said endplates and said housing.

7. A flextensional sonar projector as claimed in claim 1 wherein said limiter rod includes adjustable means to vary the length of said rod.

8. A flextensional sonar projector as claimed in claim 1 wherein said elliptical interior chamber has small radius ends along its major axis and substantially flat areas are formed on the interior of said housing at its small radius ends and said head members having mating flat surfaces contacting said flat areas.

9. A flextensional sonar projector as claimed in claim 8 wherein a layer of grease is positioned between said substantially flat areas and said head members.

10. A flextensional sonar projector as claimed in claim 1 wherein said tail members include external grooves and clip members are fastened to said center support beam such that said clip members extend into said grooves thereby securing said tail members to said center support beam.

11. A flextensional sonar projector as claimed in claim 1 wherein said transducer stacks are wrapped with a strong fabric material.

12. A flextensional sonar projector as claimed in claim 11 wherein said transducer stacks are wrapped with glass fiber.

13. A flextensional sonar projector as claimed in claim 1 wherein said transducer head members have a bore along the axes thereof, bores are formed in said ends of said housing aligned with said head member bores and alignment pins are positioned in said bores.

14. A flextensional sonar projector including a hollow shell of elliptic cross section and a plurality of piezoelectric transducer elements placed in said shell such that, when energized, they tend to vibrate along the major axis of said shell, said transducer elements being arranged in a plurality of stacks of axially arranged disks, characterized in that each stack includes a plurality of disks of piezoelectric material, a stack head member interposed between said disks and said shell, a tail member, and a wrap of fabric material having substantial tensile strength wrapped around said disks, a center support member positioned along the minor axis of said shell with a plurality of said tail members of said stacks positioned against both sides of said center support member, a limiter rod carried in said center support member extending along the minor axis of said shell such that it does not contact the interior surface of said shell during normal operation of said projector but which limits inward travel of said shell if said shell is exposed to excessive external force, and means sealing the interior of said shell against the penetration of water.

15. A flextensional sonar projector as claimed in claim 14 wherein a plurality of said projectors are fastened together and said center support members include mating interlocking end surfaces.

16. A flextensional sonar projector as claimed in claim 15 wherein said sealing means includes endplates closing the exterior ends of said projector and throughbolts passing through said endplates securing said projectors together.

17. A flextensional sonar projector as claimed in claim 14 wherein said tail members include external grooves and clip members are fastened to said center support member such that said clip members extend into said grooves thereby securing said tail members to said center support member.

18. A flextensional sonar projector as claimed in claim 17 wherein said transducer stacks are wrapped with glass fiber fabric.

19. A flextensional sonar project or as in claim 18 wherein alignment means are formed in said stack head members and said shell.

20. A flextensional sonar projector as in claim 19 wherein said alignment means includes a bore in the ends of said shell, a bore in each of said stack head members and alignment pins positioned in said bores.

* * * * *